United States Patent [19]

Lassen

[11] 4,069,872

[45] Jan. 24, 1978

[54] METHOD OF AND DEVICE FOR EXTINGUISHING BURNING GASES

[75] Inventor: Harry Lassen, Kiel, Germany

[73] Assignee: Howaldtswerke-Deutsche Werft Aktiengesellschaft Hamburg und Kiel, Kiel, Germany

[21] Appl. No.: 773,049

[22] Filed: Feb. 28, 1977

[30] Foreign Application Priority Data

Mar. 3, 1976 Germany ..... 2608670

[51] Int. Cl.[2] ..... A62C 3/12

[52] U.S. Cl. ..... 169/47; 169/66; 252/2; 252/3

[58] Field of Search ..... 252/2, 3; 169/47, 66

[56] References Cited

U.S. PATENT DOCUMENTS

| | | | |
|---|---|---|---|
| 3,475,333 | 10/1969 | Meldrum et al. | 252/3 |
| 3,479,286 | 10/1965 | Gambaretto et al. | 257/3 X |
| 4,014,799 | 3/1977 | Owens | 252/3 |

FOREIGN PATENT DOCUMENTS

| | | | |
|---|---|---|---|
| 1,162,198 | 1/1964 | Germany | 252/2 |

OTHER PUBLICATIONS

Marine Engineers Review, Aug. 1972, pp. 21 to 22.

*Primary Examiner*—Leland A. Sebastian
*Attorney, Agent, or Firm*—John C. Smith, Jr.

[57] ABSTRACT

A method of and a device for extinguishing burning gases forming by evaporation of a low-temperature liquid gas stored in tank spaces and ignited upon entering atmosphere by random effects is described. The method and device include means for introducing a hydrocarbon (halone) such as difluorochlorobromomethane or trifluorobromomethane or mixtures thereof as an extinguishing agent into burning low-temperature gases underneath the root of the flame for achieving a chemical reaction with the burning low-temperature gases.

9 Claims, 1 Drawing Figure

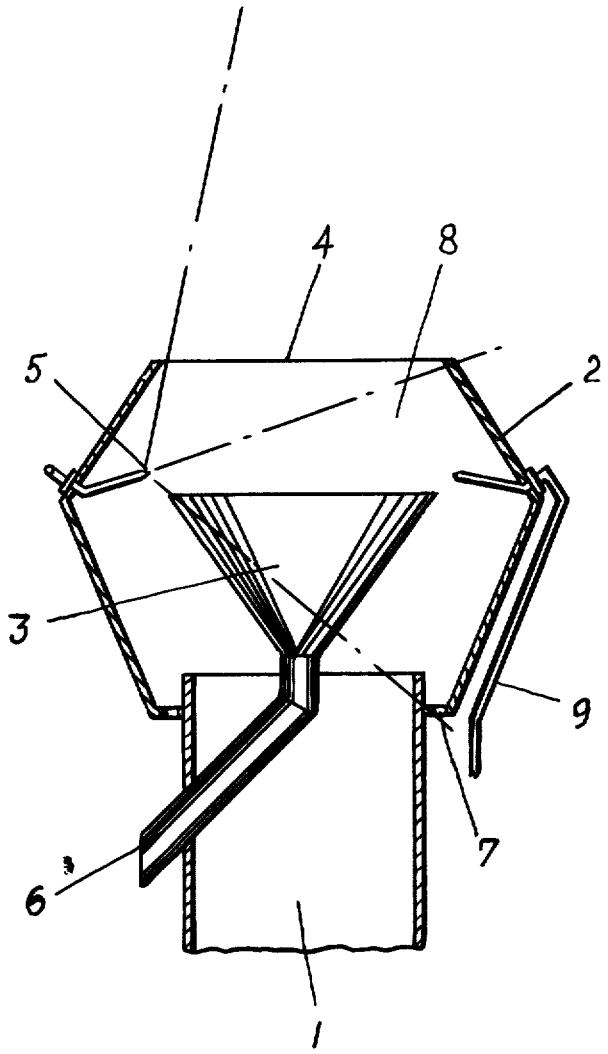
4
8
5
2
3
9
7
6
1

METHOD OF AND DEVICE FOR EXTINGUISHING BURNING GASES

BACKGROUND OF THE INVENTION

This invention relates to a method and device for extinguishing burning gases forming by evaporation of a low-temperature liquid gas stored in tank spaces and ignited upon entering atmosphere by random effects. In particular, the invention is provided for liquid gas tankers the gas containers of which are provided with degassing posts. The gas forming by evaporation discharges from the degassing posts and may ignite upon entering atmosphere by random effects.

Fire extinguishing agents of cooling or smothering extinguishing agents such as e.g. water, $CO_2$ or $N_2$ are known. For low-temperature gases these extinguishing agents are either deficient in their effect or not effective at all or not performable in use technically.

Furthermore, halogenated hydrocarbons (halones) are known for extinguishing flames which are not effective by a cooling action, but in an anticatalytic fashion. Here a reaction of the split-off halogens with the radicals H, OH and O stops the exothermal combustion. The halogens split off again in forming $H_2O$ and can act further as inhibitors. Halones find use in extinguishing systems for aircraft and for fire-fighting at airports.

SUMMARY OF THE INVENTION

It is the object of the present invention to provide a method and a device ensuring a reliable extinguishing of a flame resulting by the ignition of low-temperature (cryogenic) gases upon discharging from containers, plants or a degassing post of a liquid-gas tanker.

To attain this object the method according to the present invention comprises the steps of introducing a halogenated hydrocarbon (halone) selected from the group consisting of $CF_2ClBr$ (difluorochlorobromomethane), $CF_3Br$ (trifluorobromomethane) and mixtures thereof as an extinguishing agent into burning low-temperature gases underneath the root of the flame for achieving a chemical reaction with the burning low-temperature gases, and reliably gasifying the extinguishing agent by the radiation energy of the flame.

Along with the halogenated hydrocarbon preferably also combustion air is supplied, for the anticatalytically acting extinguishing agent "halone" has its maximum effect when the live gases burn stoichiometrically, and this is accomplished by supplying combustion air.

By introducing the halogenated hydrocarbon serving as extinguishing agent into the low-temperature live gas underneath the flame root, a part of the radiation energy, namely the downwardly directed heat radiation of the flame, may be utilized to offer a quantity of heat there which permits the desired reaction of the live gas with the extinguishing agent in that the extinguishing agent introduced can reliably gasify and extinguishes the flame by the chemical reaction with the live gas. This is an anticatalytic reaction, the radiation energy of the flame supporting the chemical reaction in that the gasifying heat reqired for the reaction is supplied to the extinguishing agent injected liquid. The extinguishing process is thus permitted by heat and is supported by combustion air, quite contrary to conventional extinguishing processes in which the heat effect and the combustion air supply are to be prevented as far as possible.

The device for performing the method comprises a tubular gas duct having a free gas-discharge end and being arranged to guide gases forming by evaporation of a low-temperature liquid gas in a tank space from said tank space into the atmosphere, and inlet sockets arranged at a point downstream from the gas-discharge end of the tubular gas duct and adapted to eject halogenated hydrocarbon serving as an extinguishing agent.

The inlet sockets may be directed into the interior of the tubular gas duct the free end of which, moreover, may be in the form of a cone hood. This cone hood may contain a gas duct cone serving as a rain discharge and as combustion air supply means. The suction action and thus the accelerated flow about the hood parts of combustion air at an atmospheric temperature at the same time achieve a cooling effect of the hood material. The inlet sockets for the extinguishing agent may be defined as nozzles injecting both to the reaction site and to the lower portion of the cone hood. Through the tubular gas duct and the degassing post, respectively, the low-temperature gas, e.g. methane gas, discharges at about −150° C at a relatively high velocity. In order to intensify the chemical reaction the live gas passage cross section at the site of the intended reaction is enlarged, and thereby the live gas velocity is reduced. The gasifying process of the extinguishing agent as well as the chemical reaction thereof with the live gas are given a longer retention time and may become completely effective more reliably. Preferably, the enlargement of the live gas passage cross section is formed as a cone hood.

BRIEF DESCRIPTION OF THE DRAWING

An embodiment of a cone hood for the live gas discharge will now be described with reference to the accompanying drawing in which the only FIGURE is a longitudinal section of the hood.

DESCRIPTION OF THE PREFERRED EMBODIMENT

The drawing shows the upper end of a degassing post or tubular gas duct 1 which supports a cone hood 2 enlarging the cross section of the live gas passage. Within the cone hood 2, a gas duct cone 3 is arranged the upper diameter of which to advantage is as large as that of the gas discharge plane 4. This permits an unobstructed gas discharge directed vertically upwardly and a hood-free rain collector. The gas duct cone 3 has a central rain discharge 6.

In order to promote the supply of combustion air, at the site 8 of the intended extinguishing reaction lateral openings 7 and conduits, e.g. rain discharge openings, to the environment are provided. They supply combustion air to the flame. Thus, the beginning of combustion is at an advantageous mixture ratio of live gas to combustion air.

Halone is supplied by means of inlet sockets 5, preferably in the form of nozzles, which are set in such a way that the extinguishing agent is sprayed into the upper interior space (reaction site 8) of the cone hood 2 and thereby a partial amount of the extinguishing agent enters the colder lower portion of the cone hood 2 and there gasifies with a time delay. After the actual initial extinguishing process, the additional partial amount has been gasified and has formed a further extinguishing active volume which prevents a later reignition.

OPERATION

The resulting live gas stream enters the cone hood 2 through a tubular gas duct 1 along the gas duct cone 3, passes the nozzles 5 and discharges vertically into atmosphere through the gas discharge plane 4. The function is enhanced by the structural configuration of the cone hood 2 in which the rain dropping is collected in the gas duct cone 3 and is passed off to the outside through a rain discharge 6. Rain incident inclined in parts runs along the inner walls of the cone hood 2 and likewise is passed to the outside through lateral openings 7. Thereby, the interior of the degassing post is extensively protected against incident rain.

When live gas is ignited, extinguishing agent halone is supplied via the nozzles 5 through conduits 9 through the intermediary of a manual or automatic control not illustrated. The radiation energy of the flame gets to the live gas passage cross section at the reaction site 8 through the gas discharge plane 4. The combustion is supported by supplying combustion air by means of the openings of the central rain discharge 6 and the lateral openings 7.

As a result of the chemical reaction of the extinguishing gas halone and live gas the combustion process is interrupted, and the flame extinguishes. In order to prevent a later reignition of the flame, a multiple of the extinguishing agent amount needed for a single extinguishing process is injected. In doing so, a partial amount of the extinguishing agent passes into the lower, i.e. cooler portion of the cone hood 2 and there gasifies with a time delay. After the actual initial extinguishing process, this amount has gasified and has formed a further extinguishing-active amount which prevents a later reignition of the flame.

The invention may be embodied in other specific forms without departing from the spirit or essential characteristics thereof. The embodiment is therefore to be considered in all respects as illustrative and not restrictive.

What is claimed is:

1. A method of extinguishing burning gases forming by evaporation of a low-temperature liquid gas stored in tank spaces and ignited upon entering atmosphere by random effects, comprising the steps of a. introducing a halogenated hydrocarbon selected from the group consisting of $CF_2ClBr$ $CF_3Br$ and mixtures thereof as an extinguishing agent into burning low-temperature gases underneath the root of the flame for achieving a chemical reaction with the burning low-temperature gases, and b. reliably gasifying the extinguishing agent by the radiation energy of the flame.

2. A method as claimed in claim 1, wherein combustion air is supplied in addition to the halogenated hydrocarbon.

3. A device for extinguishing burning gases forming by evaporation of a low-temperature liquid gas stored in tank spaces and ignited upon entering atmosphere by random effects, comprising a tubular gas duct having a free gas-discharge end and being arranged to guide gases forming by evaporation of a low-temperature liquid gas in a tank space from said tank space into the atmosphere, and inlet sockets arranged at a point downstream from the gas-discharge end of the tubular gas duct and adapted to eject halogenated hydrocarbon serving as an extinguishing agent.

4. A device as claimed in claim 3, wherein the inlet sockets are directed into the interior of the tubular gas duct.

5. A device as claimed in claim 3, wherein the free end of the tubular gas duct is in the form of a cone hood.

6. A device as claimed in claim 5, wherein a gas duct cone which at the same time serves as a rain discharge and as combustion air supply means is arranged in the cone hood.

7. A device as claimed in claim 5, wherein openings serving as rain discharge and as combustion air supply means are provided in the lower portion of the cone hood.

8. A device as claimed in claim 3, wherein the inlet sockets are in the form of nozzles.

9. A device as claimed in claim 5, wherein the cone hood contains a reaction site, and the inlet sockets are in the form of nozzles arranged mainly to spray to the reaction site and a partial amount to the lower portion of the cone hood.

* * * * *